United States Patent [19]

Ohashi et al.

[11] Patent Number: 4,547,274

[45] Date of Patent: Oct. 15, 1985

[54] SUPPORT FOR LITHOGRAPHIC PRINTING PLATE AND LITHOGRAPHIC PRINTING PLATE

[75] Inventors: Azusa Ohashi; Hirokazu Sakaki; Haruo Nakanishi, all of Shizuoka; Zenichi Tanabe, Aichi; Shin Tsuchida, Aichi; Yoshikatsu Hayashi, Aichi, all of Japan

[73] Assignees: Fuji Photo Film Co., Ltd.; Sumitomo Light Metal Industries Ltd., both of Japan

[21] Appl. No.: 500,203

[22] Filed: Jun. 1, 1983

[30] Foreign Application Priority Data

Jun. 1, 1982 [JP] Japan ..... 57-92080

[51] Int. Cl.[4] ..... C25F 3/00; C25F 3/04

[52] U.S. Cl. ..... 204/129.4; 204/129.18

[58] Field of Search ..... 204/129.1, 129.4, 129.43, 204/129.75, 129.95

[56] References Cited

U.S. PATENT DOCUMENTS

| | | | |
|---|---|---|---|
| 3,935,080 | 1/1976 | Gumbinner | 204/129.75 |
| 3,980,539 | 9/1976 | Lloyd | 204/129.75 |
| 4,198,278 | 4/1980 | Mehada | 204/129.75 |
| 4,301,229 | 11/1981 | Sakaki | 204/129.4 |
| 4,367,124 | 1/1983 | Kikuchi | 204/129.95 |
| 4,427,500 | 1/1984 | Platzer | 204/129.75 |

*Primary Examiner*—T. M. Tufariello

*Attorney, Agent, or Firm*—Sughrue, Mion, Zinn, Macpeak, and Seas

[57] ABSTRACT

A lithographic printing plate support and a process for producing it are disclosed. The plate is produced by providing an aluminum alloy material which is comprised of 0.20 to 1.0% Fe, 0.005 to 0.1% of an element selected from the group consisting of Sn, In, Ga and Zn and the remainder being aluminum. The alloy may further contain 0.1 to 2% Cu. After providing the aluminum material either or both of its surfaces are subjected to a chemical etching treatment in order to provide a uniform and dense grain structure on the surface forming primary pits in the surface having a particularly defined average size. The surface is then subjected to electrochemical etching treatment in an acidic electrolytic solution in order to provide secondary pits on the surface also having a particularly defined average size. The support base may be further treated to provide in additional coating thereon or directly coated with a light-sensitive layer in order to provide a light-sensitive lithographic printing plate. By providing the particular alloy material and subjecting it to the disclosed treatment the light-sensitive layer has good adhesion with respect to the support.

16 Claims, No Drawings

SUPPORT FOR LITHOGRAPHIC PRINTING PLATE AND LITHOGRAPHIC PRINTING PLATE

CROSS REFERENCES

This application is related to our U.S. application entitled "Aluminum Alloy, a support of lithographic printing plate and a lithographic printing plate using the same" filed with this application and based on the disclosure contained within Japanese Patent Application 92079/82 filed on June 1st, 1982.

FIELD OF THE INVENTION

This invention relates to a support for a lithographic printing plate and, more particularly, to a support of an aluminum alloy material for a lithographic printing plate. Further, it relates to a light-sensitive lithographic printing plate using such a support.

BACKGROUND OF THE INVENTION

In using aluminum plates as supports for printing plates, they are usually subjected to a treatment for roughening their surfaces in order to ensure good intimate adhesion between the aluminum plate and a light-sensitive film to be provided thereon and improve water retention in non-image areas. This surface-roughening treatment is called graining, and includes mechanical graining such as ball graining, sand blast graining or brush graining, electrochemical graining which is also called electrolytic polishing, and chemical etching which is called chemical graining. These conventional graining processes possess advantages and disadvantages. In general, problems with the mechanical graining process include scuff marks, stains, residue of an abrasive used, etc. The electrochemical graining process makes it possible to change the depth of the graining as well as the form of grains by controlling the quantity of electricity. However, it requires a large quantity of electricity and a long time for creating grains suited for printing plates, leading to high production costs.

On the other hand, the chemical graining process grains an aluminum or aluminum alloy plate by a chemical etching reaction using an acid or alkali etchant, and hence it is simple and suited for continuously treating aluminum or aluminum alloy strips, and is particularly advantageous for industrially producing plates having been treated on both sides. However, it has so far been difficult to produce high quality printing plates using commercially available aluminum or aluminum alloy. Because, conventional chemical etching processes have difficulty in forming a surface having enough surface roughness and uniform pit pattern (wherein etching pits have a uniform diameter and a uniform depth) to give sufficient printing durability and staining resistance required for printing plates.

SUMMARY OF THE INVENTION

The present invention relates to a novel support for a lithographic printing plate, which shows good solution velocity for chemical etching treatment and has superimposed composite grains produced by etching with a widely used acid or alkali an aluminum alloy containing an intermetallic compound capable of accelerating formation of uniform pits to thereby form a rough surface containing uniformly and densely distributed pits having an average roughness of 0.3 to 1.2 μm (presented as Ra) or an average depth of 1 to 10 μm at least on one surface of the alloy plate, and electrochemically etching the plate in an acidic electrolytic solution to thereby form secondary pits having an average depth of 1 μm or less or an average opening diameter of 5 μm or less.

DETAILED DESCRIPTION OF THE INVENTION

The alloy composition in accordance with the present invention is described below.

In order to accelerate solution velocity of aluminum, it is desired to first enlarge the local cathode area as large as possible, then to use the baser local anode. For this purpose, incorporation of much impurities is recommended. Addition of 0.20 to 1.0 wt% of Fe and 0.1 to 2 wt% of Cu has been found to be effective. If the contents of Fe and Cu are more than is described above, the anode area is reduced, resulting if formation of a non-uniform etching pit pattern. In addition, an anodically oxidized film of aluminum is difficult to produce on impurities, and, hence, incorporation of too much impurities would cause film defects, resulting in the formation of background stain upon printing. Alloys containing Fe and Cu show such a large solution velocity for both acids and alkalis that a proper solution can be selected depending upon the amount of etching desired and the desired pattern.

Addition of such elements as Sn, In, Ga and Zn renders a matrix electrochemically baser (less procious), thus accelerating solution velocity. Plates containing these elements may be employed for relief printing plates disclosed in Japanese Patent Publication No. 9930/74. With relief printing plates, a pattern with a depth of several mm, i.e., 1 to 20 mm, is required, whereas with lithographic printing plates, the depth is several microns, i.e., 0.1 to 5μ, at most, which means that the pit pattern must be fine.

It has been surprisingly found that addition of slight amounts of Sn, In, Ga or Zn series elements as described above to Fe and Cu alloys renders the resulting pit pattern extremely fine though solution velocity is not substantially influenced. These elements are added in an amount in the range of 0.005 to 0.1 wt% and particularly if the elements Sn, In and Ga are added in amounts greater than 0.1 wt%, the solution limit is exceeded to the extent that local dissolution becomes serious, making it difficult to form a uniform pit pattern.

The printing plate support in accordance with the present invention is produced as follows. The chemical etching of the aluminum alloy is carried out using an acid or alkali such as hydrochloric acid, nitric acid, sulfuric acid, phosphoric acid, hydrofluoric acid, etc., or a mixture of two or three of them can be used as the acid, and sodium hydroxide, sodium carbonate, sodium tertiary phosphate, sodium silicate, etc., are used as the alkali. Concentration and temperature of the etching solution depend upon etching time and required surface roughness and, usually, the concentration ranges from 1 to 50%, the temperature from 20° C. to 90° C., and the treating time from 10 seconds to about 4 minutes. Where the plate is stained, for example, with a rolling oil, a degreasing treatment is conducted prior to the chemical etching. In order to remove smut remaining on the etched surface, pickling is effected. Acids to be used for the pickling include nitric acid and sulfuric acid. The pickling reaction can be accelerated by adding hydrogen peroxide.

The surface of the thus-treated aluminum plate must have uniformly and densely distributed pits having an average depth of 1 to 10μ, which corresponds to an average roughness of 0.3 to 1.2 μm (presented as Ra).

The average depth of pits is an important parameter in determining surface roughness and a uniform pit pattern is necessary for attaining printing durability and staining resistance required for printing plates. If the pit depth is less than 1 μm, the surface roughness is limited to 0.2 μm (Ra) at the highest which fails to give high printing durability and enough water retention to the resulting printing plate. On the other hand, if the pit depth is more than 10 μm, the surface roughness exceeds 1.2 μm (Ra) and staining resistance tends to be deteriorated. In addition, it becomes substantially difficult to form a uniform etching pit pattern wherein the pits have a uniform diameter and a uniform depth, and the amount of etched aluminum is increased, resulting in an unpractically high etching cost.

The base plate having an average roughness of 0.3 to 1.2 μm (Ra) can itself be practically used as a lithographic printing plate by providing thereon an anodically oxidized film to strengthen corrosion resistance and abrasion resistance of the surface. However, under severe printing conditions or for conducting printing with high quality such as color printing, the plate must be further improved in view of printing durability, staining resistance, and tone reproducibility.

As a result of intensive investigations, the inventors have found that a support for a lithographic printing plate having improved printing durability, staining resistance, and tone reproducibility can be produced by subjecting the above-described surface to an electrochemical etching treatment in an electrolytic solution containing hydrochloric acid or its salt, nitric acid or its salt, or a mixture thereof using DC or AC. Concentration of the acid or salt thereof in the electrolytic solution is preferably 0.1 to 100 g, more preferably 0.5 to 60 g, per liter of the electrolytic solution. The temperature of the electrolytic solution ranges preferably from 20° C. to 60° C., and the treating time from 1 second to 10 minutes, preferably 3 seconds to 5 minutes. Conditions of electrochemical etching depend on required surface roughness and pit pattern of the support. Observation of the surface of the thus-obtained support under a scanning type electron microscope (SEM) revealed that secondary pits having an average opening diameter of 5 μm or less were uniformly and superimposedly distributed. In addition, a section of the support was prepared by using a microtome, and the profile of the section was surveyed under the scanning electron microscope to find that the average depth of the pits was 1 μm or less. Samples having widely varying diameters and depths of pits can be prepared by properly selecting the kind of electrolytic bath, kind of source of electric power, and electrolysis conditions. The support thus-obtained by the electrochemical etching treatment has an average roughness of 0.3 l to 1.2 μm (Ra) which is almost the same value as the support obtained by the chemical etching.

As a result of detailed investigations, the inventors have found that the best balanced performance including printing durability, staining resistance, tone reproducibility, etc., can be obtained by forming the secondary pits having an opening diameter of 5 μm or less or a depth of 1 μm or less on the surface having the primary pits of 1 to 10 μm in depth. If the pits have an opening diameter of more than 5 μm or a depth of more than 1 μm, the primary pits are destroyed and suffer reduction of substantial pit depth, adversely affecting printing durability and water retention.

Formation of the secondary pits by electro-chemical etching can be effected by using an electrolytic bath of either hydrochloric acid or nitric acid. In order to render the pit diameter uniform, electric current of a special alternating wave described in U.S. Pat. No. 4,087,341, compounds such as amines described in U.S. Pat. No. 3,755,116, sulfuric acid described in Japanese Patent Application (OPI) No. 57902/74 (the term "OPI" as used herein refers to a "published unexamined Japanese patent application"), boric acid described in U.S. Pat. No. 3,980,539, phosphoric acid shown in West Germany Patent Application(OLS) 2,250,275 and U.S. Pat. No. 3,887,447, etc., may be employed or added.

Stains remaining on the electrochemically etched surface can be removed by contacting the surface with 50° to 90° C., 15 to 65 wt% sulfuric acid as described in Japanese Patent Application (OPI) No. 12739/78 or by etching with an alkali described in Japanese Patent Publication No. 28123/73.

The thus-treated aluminum plate can be further subjected to an anodizing process. Anodizing conditions are changed depending upon what kind of electrolytic solution is used and, therefore, they cannot be determined indiscriminately. However, as a general guide, it can be said that an electrolytic solution having a concentration of 1 to 80 wt%, a solution temperature of 5° to 70° C., a current density of 0.5 to 60 ampere/dm$^2$. a voltage applied of 1 to 100 v and an electrolyzing time of 10 to 100 seconds can produce a preferable result.

Particularly effective anodically oxidized film forming processes are the processes used in British Pat. No. 1,412,768, wherein anodic oxidation is carried out in sulfuric acid by sending a high density electric current, and the process described in U.S. Pat. No. 3,511,661 (incorporated herein by reference to disclose a process), wherein anodic oxidation is carried out using phosphoric acid as an electrolytic bath. The thickness of the anodically oxidized film is preferably 0.1 to 10 g/m$^2$, more preferably 0.1 to 5 g/m$^2$.

The aluminum plate which has been anodically oxidized may be further treated with an aqueous solution of an alkali metal silicate such as sodium silicate or the like using a conventional technique, e.g., a dipping technique, as described in U.S. Pat. Nos. 2,714,066 and 3,181,461 (incorporated herein by reference to disclose such techniques). Alternatively, a subbing layer made up of hydrophilic cellulose (e.g., carboxymethyl cellulose, etc.) containing a water-soluble metal salt (e.g., zinc acetate, etc.) and ranged in preferable thickness of 0.001 to 1 g/m$^2$, more preferable thickness of 0.005 to 0.5 g/m$^2$, may be additionally provided on the anodically oxidized aluminum plate, as described in U.S. Pat. No. 3,860,426 (incorporated herein by reference to disclose how to provide a subbing layer).

On the lithographic printing plate support prepared in accordance with an embodiment of the present invention, a light-sensitive layer which is known to have been used for presensitized plates is provided to produce a light-sensitive lithographic printing plate. The lithographic printing plate obtained by subjecting this presensitized plate to a plate making process has excellent properties.

Suitable examples of the composition of the above-described light-sensitive layer are described below:

(1) Light-sensitive layer comprised of a diazo resin and a binder:

Preferred examples of the diazo resin include those described in U.S. Pat. Nos. 2,063,631, 2,667,415, Japanese Patent Publication Nos. 48001/74, 45322/74, 45323/74, and British Pat. Nos. 1,312,925 and 1,023,598. Preferred examples of the binder include those described in British Pat. Nos. 1,350,521 and 1,460,978, and U.S. Pat. Nos. 4,123,276, 3,751,257, and 3,660,097, and Japanese Patent Application (OPI) No. 98614/79.

(2) Light-sensitive layer comprised of an o-quinonediazide compound:

Particularly preferred examples of the o-quinonediazide compound include o-naphthoquinonediazide compounds as described in U.S. Pat. Nos. 2,766,118, 2,767,092, 2,772,972, 2,859,112, 2,907,665, 3,046,110, 3,046,111, 3,046,115, 3,046,118, 3,046,119, 3,046,120, 3,046,121, 3,046,122, 3,046,123, 3,061,430, 3,102,809, 3,106,465, 3,635,709 and 3,647,443 and many other piblications.

(3) Light-sensitive layer comprised of a composition containing an azide compound and a binder (macromolecular compound):

Specific examples of the composition include compositions comprised of azide compounds and water-soluble or alkali-soluble macromolecular compounds which are described in British Pat. Nos. 1,235,281 and 1,495,861, Japanese Patent Application (OPI) Nos. 32331/76 and 36128/76, and so on, and compositions comprised of azido group-containing polymers and macromolecular compounds as binders, as described in Japanese Patent Application (OPI) Nos. 5102/75, 84302/75, 84303/75 and 12984/78.

(4) Light-sensitive layers comprised of other light-sensitive resinous compositions:

Specific examples include the polyester compounds disclosed in Japanese Patent Application (OPI) No. 96696/77, polyvinyl cinnamate series resins described in British Pat. Nos. 1,112,277, 1,313,390, 1,341,004 and 1,377,747, and photopolymerizable photopolymer compositions described in U.S. Pat. Nos. 4,072,528 and 4,072,527, and so on.

The amount (thickness) of the light-sensitive layer to be provided on the support is controlled to about 0.1 to about 7 g/m$^2$, preferably 0.5 to 4 g/m$^2$.

Presensitized plates, after imagewise exposure, are subjected to processings including a developing step in a conventional manner to form resin images. For instance, a presensitized plate having the light-sensitive layer (1) constituted with a diazo resin and a binder has unexposed portions of the light-sensitive layer removed by development after imagewise exposure to produce a lithographic printing plate.

The present invention will now be described in more detail by reference to the following examples. However, the scope of the invention is not limited to these examples.

EXAMPLE 1

The following 8 aluminum alloy plates were prepared and subjected to a chemical etching treatment for 1 minute at 60° C. in 10% NaOH. Surface roughness of the thus-treated plates and opening diameter of pits determined through observation of the pit pattern under a scanning electron microscope (SEM) are tabulated in Table 2.

TABLE 1

| | (% by weight) Alloy Composition | | | | | |
|---|---|---|---|---|---|---|
| No. | Fe | Cu | Sn | In | Ga | Zn |
| 1 | 0.70 | 0.50 | 0.04 | — | — | — |
| 2 | 0.70 | 0.50 | — | 0.06 | — | — |
| 3 | 0.70 | 0.30 | — | — | 0.03 | — |
| 4 | 0.70 | 0.50 | 0.05 | — | — | 0.20 |
| 5 | 0.30 | 0.60 | 0.04 | — | — | — |
| 6 | 0.70 | — | 0.04 | — | — | — |
| Comparative Example 1 | 0.70 | 0.50 | — | — | — | — |
| Comparative Example 2 | 0.10 | — | 0.05 | — | — | — |

TABLE 2

| | Properties of Chemically Etched Surface | | |
|---|---|---|---|
| | Etching in NaOH Solution | | |
| No. | Surface Roughness (Ra) | Pit Pattern | Opening Diameter |
| 1 | 0.35 | Uniform | Uniform pits of 2 to 8 μ |
| 2 | 0.33 | " | " |
| 3 | 0.30 | " | " |
| 4 | 0.37 | " | " |
| 5 | 0.37 | " | " |
| 6 | 0.34 | " | " |
| Comparative Example 1 | 0.34 | Non-uniform | Coarse pits of 7 to 15 μ |
| Comparative Example 2 | 0.19 | Uniform | Uniform pits of 2 to 8 μ |

As is clear from Table 2, Comparative Sample 1 not containing Sn, In, Ga and Zn formed coarse pits, and Comparative Sample 2 containing a less amount of Fe had a low surface roughness.

Samples given in Table 2 were subjected to an electrochemical etching treatment in a 7 g/liter nitric acid aqueous solution in an electricity amount of 100 coulomb/dm$^2$ using a special alternating wave current described in Japanese Patent Application (OPI) No. 67507/78, then subjected to desmutting treatment of dipping in a 30% $H_2SO_4$ aqueous solution at 55° C. for 1 minute. Subsequently, a 3 g/m$^2$ thick oxide film was formed thereon in an electrolytic solution containing 20% sulfuric acid as a major component at a temperature of 30° C., followed by dipping in a 2.5% aqueous solution of JIS No. 3 sodium silicate at 60° C. for 1 minute, thoroughly washing with water, and drying.

Surface roughness of each of the thus-obtained samples was determined, and their pit patterns were observed under a scanning electron microscope (SEM) to determine the opening diameter. Also, a section of each sample prepared by a microtome was observed under SEM to measure the pit depth.

Results thus-obtained are tabulated in Table 3.

TABLE 3

| | Properties of Electrochemically Etched Surface | | |
|---|---|---|---|
| No. | Surface Roughness | Depth of Secondary Pits | Opening Diameter of Secondary Pits |
| 7 | 0.35 | 0.1-0.8 μm | 1-3 μm |
| 8 | 0.34 | " | " |
| 9 | 0.32 | " | " |
| 10 | 0.37 | " | " |
| 11 | 0.38 | " | " |
| 12 | 0.37 | " | " |
| Comparative Example 3 | 0.36 | " | " |
| Comparative | 0.20 | " | " |

TABLE 3-continued

| No. | Properties of Electrochemically Etched Surface: Surface Roughness | Depth of Secondary Pits | Opening Diameter of Secondary Pits |
|---|---|---|---|
| Example 4 | | | |

EXAMPLE 2

Sample No. 6 described in Example 1, Table 2 was anodized and rendered hydrophilic in the same manner as in Example 1 to prepare Sample A of support. Similarly, Samples B and C were prepared from Sample No. 12 and Comparative Sample No. 4 given in Example 1, Table 3. On each of the thus-prepared Samples A, B and C was coated the following light-sensitive layer in a dry thickness of 2.0 g/m$^2$.

| | |
|---|---|
| 2-Hydroxyethyl methacrylate copolymer (synthesized according to the process described in Example 1 of British Patent 1,505,739) | 0.7 g |
| 2-Methoxy-4-hydroxy-5-benzoylbenzene-sulfonate of a condensate between p-diazophenylamine and paraformaldehyde | 0.1 g |
| Oil Blue #603 (product of Orient Chemical Co., Ltd.) | 0.03 g |
| 2-Methoxyethanol | 6 g |
| Methanol | 6 g |
| Ethylenedichloride | 6 g |

The thus-obtained light-sensitive lithographic printing plates were each imagewise exposed for 70 seconds by means of a metal halide lamp of 3 kw placed at a distance of 1 meter, and dipped in the following developing solution for 1 minute at room temperature. Then, the surface of each plate was lightly rubbed by an absorbent wadding to remove unexposed areas, thus lithographic printing plates (A), (B) and (C) were obtained, respectively.

| Formulation of Developing Solution: | |
|---|---|
| Sodium sulfite | 3 g |
| Benzyl alcohol | 30 g |
| Triethanolamine | 20 g |
| Monoethanolamine | 5 g |
| Pelex NBL (sodium t-butylnaphthalene-sulfonate; product of Kao Atlas Co., Ltd.) | 30 g |
| Water | 1,000 ml |

Then, printing was conducted in a conventional manner to obtain the results shown in Table 4.

TABLE 4

| Sample Support | (A) No. 6 given in Example 1, Table 2 | (B) No. 12 given in Example 1, Table 3 | (C) Comparative Example 4 given in Example 1, Table 3 |
|---|---|---|---|
| Surface roughness | 0.34 μm | 0.37 μm | 0.20 μm |
| Primary pits: | | | |
| Average depth | 1-10 μm | 1-10 μm | 1-6 μm |
| Opening diameter | 2-8 μm | 2-8 μm | 2-8 μm |
| Secondary pits: | | | |
| Average depth | — | 0.1-0.8 μm | 0.1-0.8 μm |
| Opening diameter | — | 1-3 μm | 2-5 μm |
| Amount of electrochemically etching electricity | — | 100 coul/dm$^2$ | 100 coul/dm$^2$ |
| Weight of anode oxidation film | 3.0 g/m$^2$ | 3.0 g/m$^2$ | 3.0 g/m$^2$ |
| Printing durability | 80,000 | 150,000 | 100,000 |
| Staining resistance | Excellent | Excellent | Fair |

While the invention has been described in detail and with reference to specific embodiments thereof, it will be apparent to one skilled in the art that various changes and modifications can be made therein without departing from the spirit and scope thereof.

What is claimed is:

1. A support for a lithographic printing plate, which comprises an aluminum alloy material containing 0.20 to 1.0% Fe and 0.005 to 0.1% of at least one of the elements Sn, In, Ga and Zn and having at least on one surface thereof a unifrom and dense grain structure formed by subjecting its surface to a chemical etching treatment carried out using a material selected from the group consisting of an acid and an alkali and then to an electrochemical etching treatment in an acidic electrolytic solution containing a material selected from the group consisting of hydrochloric acid or its salt, nitric acid or its salt, and a mixture thereof and using current selected from the group consisting of DC and AC.

2. The support for lithographic printing plate as described in claim 1, wherein said aluminum alloy material further contains 0.1 to 2% Cu.

3. The support for lithographic printing plate as described in claim 1, wherein the surface of said aluminum alloy material forms a rough plane having primary pits of 0.3 to 1.2 μm (presented as Ra) in average roughness or 1 to 10 μm in average depth formed by the chemical etching treatment.

4. The support for lithographic printing plate as described in claim 1, wherein the surface of said aluminum alloy material forms a rough plane having secondary pits of 1 μm or less in average depth and 5 μm or less in average opening diameter formed by the electrochemical treatment.

5. A light-sensitive lithographic printing plate, which comprises a support having provided thereon a light-sensitive layer, said support comprising an aluminum alloy material containing 0.20 to 1.0% Fe and 0.005 to 0.1% of at least one of the elements Sn, In, Ga and Zn and having at least one surface thereof a uniform and dense grain structure formed by subjecting its surface to a chemical etching treatment carried out using a material selected from the group consisting of an acid and an alkali and then to an electrochemical etching treatment in an acidic electrolytic solution containing a material selected from the group consisting of hydrochloric acid or its salt, nitric acid or its salt, and a mixture thereof and using current selected from the group consisting of DC and AC.

6. A method for producing a lithographic printing plate support, comprising the steps of:

providing an aluminum alloy material comprised of 0.20 to 1.0% Fe, 0.005 to 0.1% of an element selected from the group consisting of Sn, In, Ga, and Zn, and the remainder being aluminum;

subjecting a surface of the aluminum alloy material to a chemical etching treatment carried out using a material selected from the group consisting of an acid and an alkali in order to form uniform and dense grain structure on the surface;

subjecting the surface to electrochemical etching treatment in an acidic electrolytic solution containing a material selected from the group consisting of hydrochloric acid or its salt, nitric acid or its salt, and a mixture thereof and using current selected from the group consisting of DC and AC.

7. The method for producing a lithographic printing plate support as described in claim 6, wherein the aluminum alloy material is further comprised of 0.1 to 2% Cu.

8. The method for producing a lithographic printing plate support as described in claim 7, wherein the chemical etching treatment provides pits in the surface so that the surface has an average roughness (Ra) in the range of 0.3 to 1.2 μm and the pits formed in the surface have an average depth of 1 to 10 μm.

9. The method for producing a lithographic printing plate support as described in claim 8, wherein the electrochemical treatment forms secondary pits in the surface having an average depth of 1 μm or less and an average diameter of 5 μm or less.

10. A lithographic printing plate support produced by the process comprising the steps of:

providing an aluminum alloy material comprised of 0.2 to 1.0% Fe, 0.005 to 0.1% of an element selected from the group consisting of Sn, In, Ga and Zn and the remainder being aluminum;

subjecting a surface of the aluminum alloy material to a chemical etching treatment carried out using a material selected from the group consisting of an acid and an alkali in order to form a uniform and dense grain structure on the surface; and subjecting the surface to an electrochemical etching treatment in an acidic electrolytic solution containing a material selected from the group consisting of hydrochloric acid or its salt, nitric acid or its salt, and a mixture thereof and using current selected from the group consisting of DC and AC.

11. The lithographic printing plate support produced by the process as described in claim 10, wherein the aluminum alloy material is further comprised of 0.1 to 2% Cu, the chemical etching treatment provides primary pits having an average diameter of 0.3 to 1.2 μm and an average depth of 1 to 10 μm, and the electrochemical treatment provides secondary pits having an average depth of 1 μm or less and an average diameter of 5 μm or less.

12. A method for producing a light-sensitive lithographic printing plate, comprising the steps of:

providing an aluminum alloy material comprised of 0.20 to 1.0% Fe, 0.005 to 0.1% of an element selected from the group consisting of Sn, In, Ga and Zn, 0.1 to 2% Cu and the remainder being aluminum;

subjecting a surface of the aluminum alloy material to a chemical etching treatment carried out using a material selected from the group consisting of an acid and an alkali in order to form uniform and dense grain structure on the surface with primary pits having an average diameter of 0.3 to 1.2 μm and an average depth of 1 to 10 μm;

subjecting the surface to an electrochemical etching treatment in an acidic electrolytic solution containing a material selected from the group consisting of hydrochloric acid or its salt, nitric acid or its salt, and a mixture thereof and using current selected from the group consisting of DC and AC to provide secondary pits having an average depth of 1 μm or less and an average diameter of 5 μm or less; and providing a light-sensitive layer on the uniform and dense grain structure on the surface.

13. The method for producing a light-sensitive lithographic printing plate as described in claim 12, wherein the light-sensitive layer is present in an amount within the range of 0.1 to about 7 $g/m^2$.

14. The method for producing a light-sensitive lithographic printing plate as described in claim 13, wherein the light-sensitive layer is present in an amount within the range of 0.5 to 4 $g/m^2$.

15. A support for a lithographic printing plate as claimed in claim 1, wherein the concentration of the etching solution ranges from 1 to 50%, the treating temperature ranges from 20° C. to 90° C., and the treating time ranges from 10 seconds to about four minutes, and wherein the concentration of the electrolytic solution is 0.1 to 100 g/l, the temperature of the electrolytic solution ranges from 20° C. to 60° C., and the treating time ranges from 1 second to 10 minutes.

16. A light-sensitive lithographic printing plate as claimed in claim 5, wherein the concentration of the etching solution ranges from 1 to 50%, the treating temperature ranges from 20° C. to 90° C., and the treating time ranges from 10 seconds to about four minutes, and wherein the concentration of the electrolytic solution is 0.1 to 100 g/l, the temperature of the electrolytic solution ranges from 20° C. to 60° C., and the treating time ranges from 1 second to 10 minutes.

* * * * *